US009693142B2

(12) United States Patent
Liu et al.

(10) Patent No.: US 9,693,142 B2
(45) Date of Patent: Jun. 27, 2017

(54) HOUSING OF ELECTRONIC DEVICE AND SPEAKER

(71) Applicants: HONG FU JIN PRECISION INDUSTRY (WuHan) CO., LTD., Wuhan (CN); HON HAI PRECISION INDUSTRY CO., LTD., New Taipei (TW)

(72) Inventors: Fu-Ming Liu, Wuhan (CN); Jeng-Da Wu, New Taipei (TW)

(73) Assignees: HONG FU JIN PRECISION INDUSTRY (WuHan) CO., LTD., Wuhan (CN); HON HAI PRECISION INDUSTRY CO., LTD., New Taipei (TW)

( * ) Notice: Subject to any disclaimer, the term of this patent is extended or adjusted under 35 U.S.C. 154(b) by 11 days.

(21) Appl. No.: 14/714,781

(22) Filed: May 18, 2015

(65) Prior Publication Data

US 2016/0309261 A1 Oct. 20, 2016

(30) Foreign Application Priority Data

Apr. 16, 2015 (CN) ..... 2015 1 0180062

(51) Int. Cl.

| | |
|---|---|
| ***H04R 7/04*** | (2006.01) |
| ***H04R 17/00*** | (2006.01) |
| ***H04R 7/10*** | (2006.01) |
| ***H04R 9/06*** | (2006.01) |
| *H04R 1/28* | (2006.01) |

(52) U.S. Cl.

CPC ..... *H04R 7/045* (2013.01); *H04R 7/10* (2013.01); *H04R 9/063* (2013.01); *H04R 1/2811* (2013.01); *H04R 17/00* (2013.01); *H04R 2307/023* (2013.01); *H04R 2499/11* (2013.01)

(58) Field of Classification Search

CPC H04R 2499/11; H04R 7/045; H04R 2400/03; H04R 17/00; H04R 1/2807; H04R 2440/05

See application file for complete search history.

(56) References Cited

U.S. PATENT DOCUMENTS

| | | | | |
|---|---|---|---|---|
| 6,443,586 | B1 * | 9/2002 | Azima | F21V 33/0056 362/86 |
| 8,885,862 | B2 * | 11/2014 | Rossing | H04R 1/26 381/333 |
| 2001/0026625 | A1 * | 10/2001 | Azima | H04R 7/045 381/152 |
| 2002/0027999 | A1 * | 3/2002 | Azima | B42D 15/022 381/431 |
| 2002/0118847 | A1 * | 8/2002 | Kam | H04R 7/045 381/111 |
| 2007/0036388 | A1 * | 2/2007 | Lee | H04R 1/26 381/431 |
| 2009/0034776 | A1 * | 2/2009 | Angelis | H04R 7/045 381/386 |
| 2010/0090814 | A1 * | 4/2010 | Cybart | G06F 3/016 340/407.2 |

(Continued)

*Primary Examiner* — Matthew Eason
(74) *Attorney, Agent, or Firm* — Steven Reiss

(57) ABSTRACT

A speaker includes a shell and a vibration device. The vibration device is fixed on the shell. The shell defines a closed space. The closed space is filled with gas. The vibration device can drive the shell to vibrate to produce sound. A speaker is also provided.

18 Claims, 4 Drawing Sheets

(56) References Cited

U.S. PATENT DOCUMENTS

| | | | | |
|---|---|---|---|---|
| 2010/0119095 | A1* | 5/2010 | Grenzing | H04R 7/045 381/332 |
| 2010/0156814 | A1* | 6/2010 | Weber | G06F 3/016 345/173 |
| 2013/0250500 | A1* | 9/2013 | Tossavainen | G06F 3/016 361/679.01 |
| 2015/0018046 | A1* | 1/2015 | Nabata | H04M 1/03 455/566 |
| 2015/0195630 | A1* | 7/2015 | Yliaho | H04M 1/0266 381/162 |
| 2015/0256656 | A1* | 9/2015 | Horii | H04M 1/0202 455/575.1 |
| 2015/0350775 | A1* | 12/2015 | Behles | H04R 3/002 381/354 |

* cited by examiner

HOUSING OF ELECTRONIC DEVICE AND SPEAKER

CROSS-REFERENCE TO RELATED APPLICATIONS

This application claims priority to Chinese Patent Application No. 201510180062.X filed on Apr. 16, 2015, the contents of which are incorporated by reference herein.

FIELD

The subject matter herein generally relates to a housing for electronic devices and a speaker.

BACKGROUND

The electronic devices may include speakers. The speaker is always separated from the enclosure. The separated speaker may occupy additional space.

BRIEF DESCRIPTION OF THE DRAWINGS

Implementations of the present technology will now be described, by way of example only, with reference to the attached figures.

DETAILED DESCRIPTION

Figure 1:
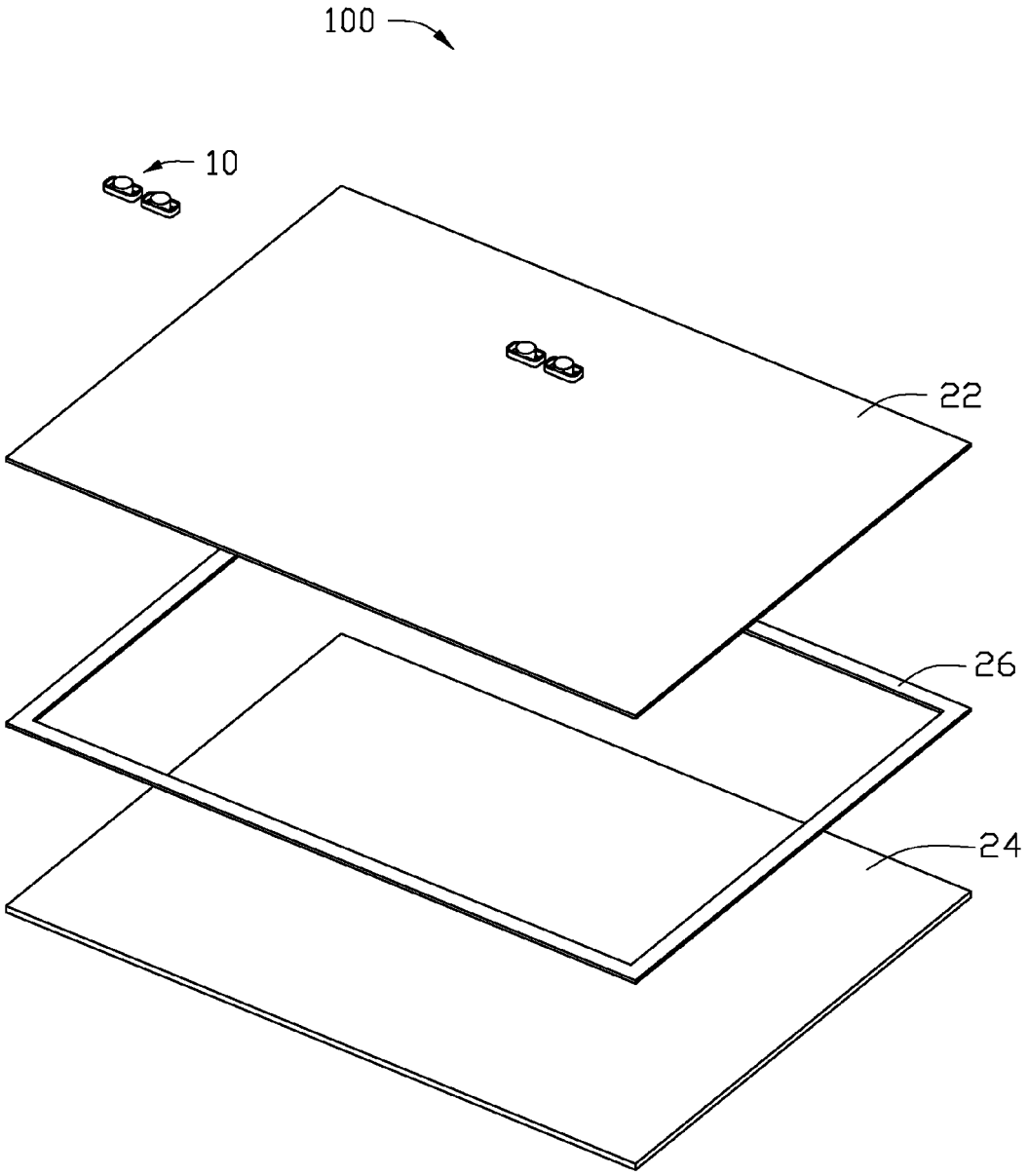
FIG. 1 is an exploded, isometric view of one embodiment of a housing of electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series and the like.

The present disclosure is described in relation to a housing of electronic device.

Figure 2:
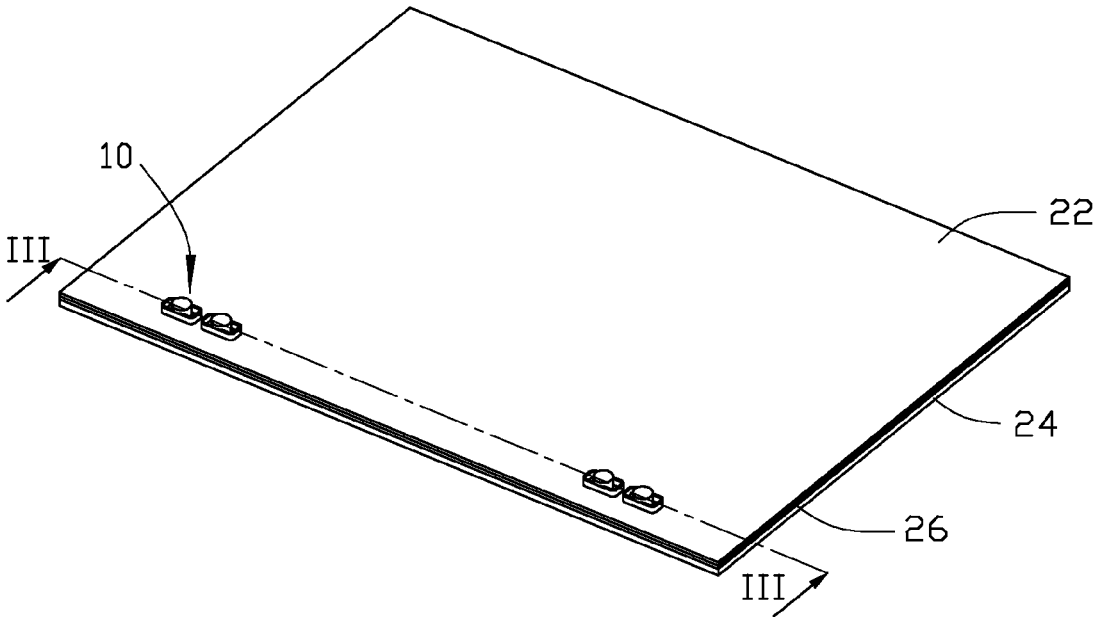
FIG. 2 is an assembled, isometric view of the housing of electronic device of FIG. 1.
Figure 3:
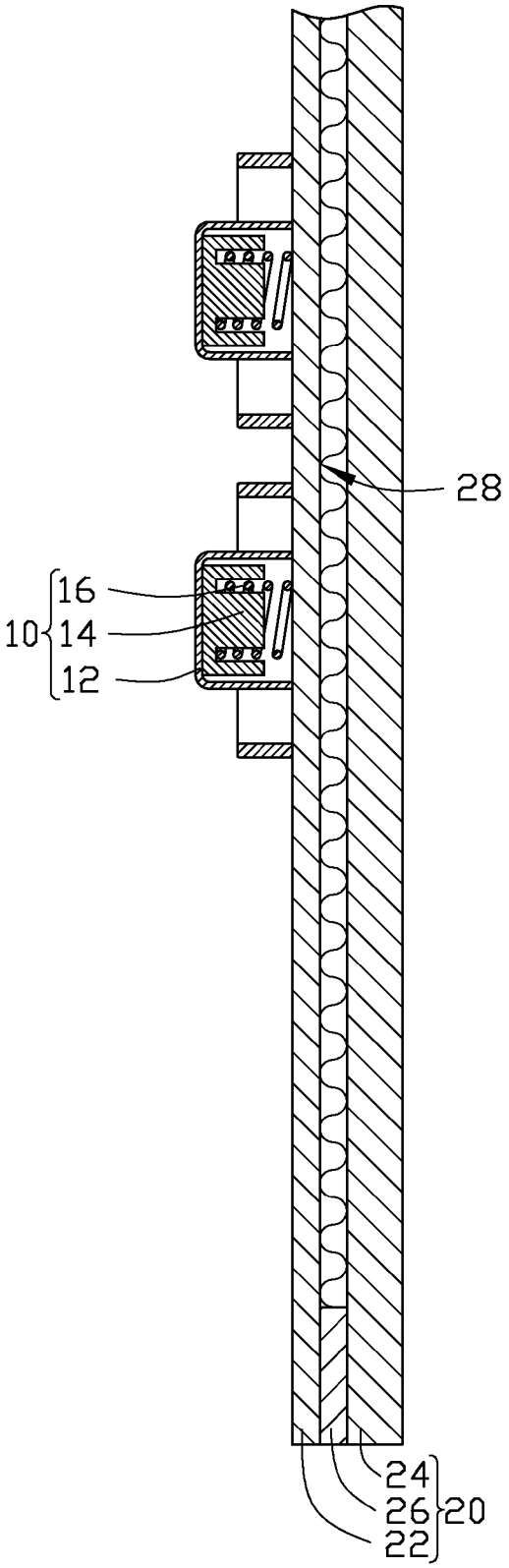
FIG. 3 is a cross-sectional view in the housing of electronic device taken along line III-III of FIG. 2.

FIGS. 1-3 illustrate one embodiment of a housing of an electronic device 100. The housing of electronic device 100 includes a plurality of vibration devices 10 and a shell 20.

Each vibration device 10 includes a main portion 12, a magnet 14, and an elastic element 16. The magnet 14 and the elastic element 16 are received in the main portion 12. In one embodiment, the elastic element 16 can be a coil.

The shell 20 includes a first plate 22, a second plate 24, and a ring seal 26. The first plate 22 and the second plate 24 are fixed by the ring seal 26. A closed space 28 is defined by the first plate 22, the second plate 24, and the ring seal 26. The closed space 28 is filled with gas. A thickness of the second plate 24 is greater than a thickness of the first plate 22. In an embodiment, the first plate 22 can be substantially parallel to the second plate 24. The first plate 22 and the second plate 24 can be made of glass. The first plate 22 can be flexible. The ring seal 26 can be made of elastic material. In an embodiment, the thickness of the first plate 22 is less than 1 mm. The thickness of the second plate 24 is less than 3 mm. A distance between the first plate 22 and the second plate 24 is less than 2 mm. The ring seal 26 can be made of plastic. The ring seal 26 is sandwiched between and adhered to the first plate 22 and the second plate 24. The closed space 28 can be full of air.

When the housing of electronic device 100 is assembled, one end of the elastic element 16 is fixed to the first plate 22. The magnet 14 is sheathed with the elastic element 16. The plurality of vibration devices 10 are fixed to one side of the first plate 22 away from the second plate 24. The plurality of vibration devices 10 are exposed on an outer side of the shell 20. When the housing of electronic device 100 is in use, the elastic element 16 is galvanically producing a magnetic field. The alternating current changes the magnetic field. The magnetic field produced by the alternating current and a magnetic field produced by the magnet 14 are interactional and drive the elastic element 16 to vibrate along a first direction. In an embodiment, the first direction can be substantially perpendicular to the shell 20. The first plate 22 and the gas within the closed space 28 vibrate via the elastic element 16. The shell 20 produces sound.

When amplitude of the elastic element 16 is greater the sound from the shell 20 is louder. The greater the vibration frequency of the elastic element 16 the higher the tone that is generated by the housing.

Figure 4:
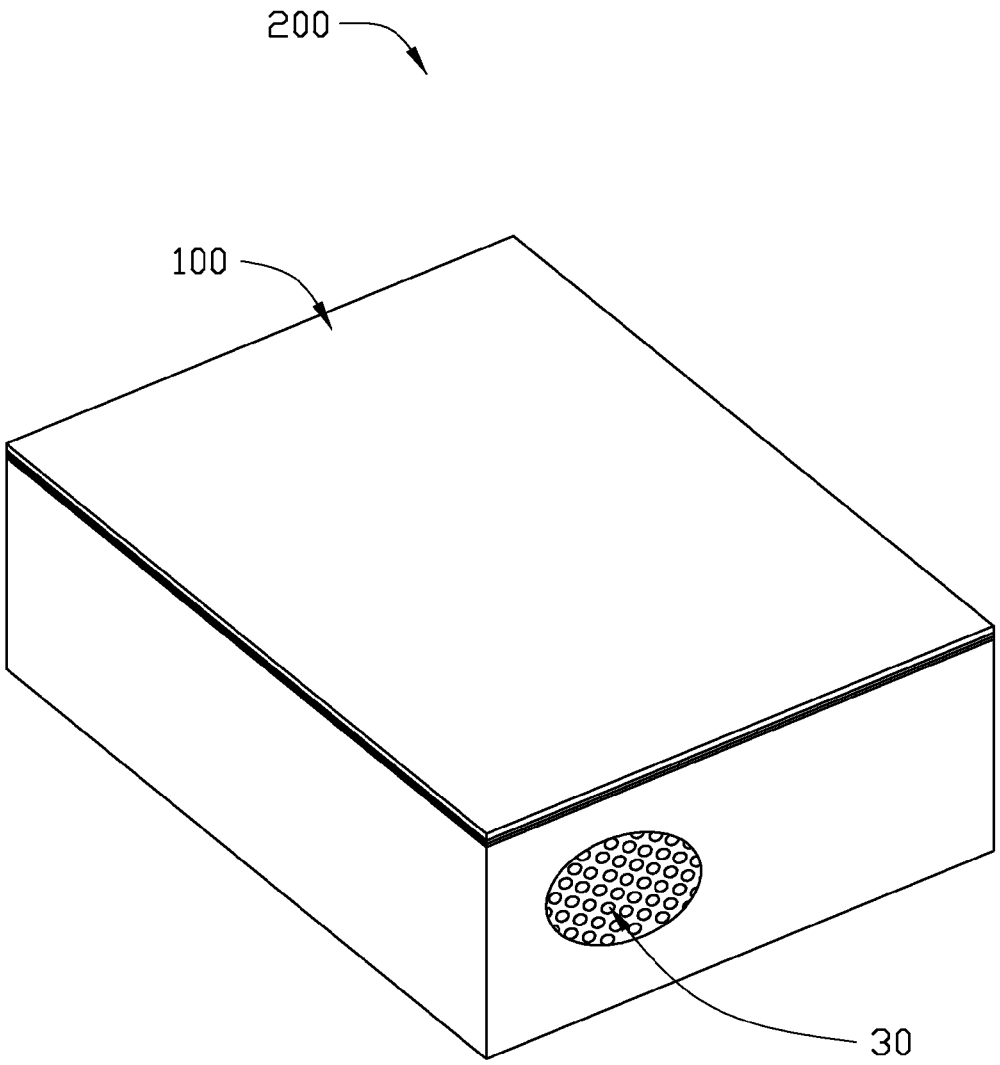
FIG. 4 is an isometric view of the housing of electronic device of FIG. 3, but in a working state.

FIG. 4 illustrates the housing of the electronic device 100 in a working state. In an embodiment, the housing of electronic device 100 can be a side plate or a cover of an electronic device 200. The housing of electronic device 100 is fixed to a body of the electronic device 200. The sound produced by the shell 20 can generate out of the electronic device 200 via an opening 30.

The embodiments shown and described above are only examples. Many details are often found in the art such as the other features of a housing of electronic device. Therefore, many such details are neither shown nor described. Even though numerous characteristics and advantages of the present technology have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. A housing of electronic device comprising:

a vibration device; and a shell defining a closed space and comprising:

a first plate;

a second plate; and a ring seal sandwiched between the first plate and the second plate;

wherein the closed space is defined by the first plate, the second plate, and the ring seal; the vibration device is fixed to the first plate and exposed on an outer side of the shell, the closed space is filled with gas, and the shell is configured to produce sound through vibration.

2. The housing of electronic device of claim 1, wherein the first plate and the second plate are made of glass.

3. The housing of electronic device of claim 2, wherein a thickness of the second plate is greater than a thickness of the first plate.

4. The housing of electronic device of claim 3, wherein the first plate is flexible.

5. The housing of electronic device of claim 4, wherein a thickness of the first plate is less than 1 mm.

6. The housing of electronic device of claim 3, wherein a thickness of the second plate is less than 3 mm.

7. The housing of electronic device of claim 2, wherein the first plate is substantially parallel to the second plate.

8. The housing of electronic device of claim 7, wherein a distance between the first plate and the second plate is less than 2 mm.

9. The housing of electronic device of claim 2, wherein the ring seal is made of elastic material and adhered to the first plate and the second plate.

10. A speaker comprising:

a vibration device; and a shell defining a closed space and comprising:

a first plate;

a second plate; and a ring seal sandwiched between the first plate and the second plate;

wherein the closed space is defined by the first plate, the second plate, and the ring seal; the vibration device is fixed to the first plate and exposed on an outer side of the shell, the closed space is filled with gas, and the vibration device is mounted to the shell to produce sound through vibration.

11. The speaker of claim 10, wherein the first plate and the second plate are made of glass.

12. The speaker of claim 11, wherein a thickness of the second plate is greater than a thickness of the first plate.

13. The speaker of claim 12, wherein the first plate is flexible.

14. The speaker of claim 13, wherein a thickness of the first plate is less than 1 mm.

15. The speaker of claim 12, wherein a thickness of the second plate is less than 3 mm.

16. The speaker of claim 11, wherein the first plate is substantially parallel to the second plate.

17. The speaker of claim 16, wherein a distance between the first plate and the second plate is less than 2 mm.

18. The speaker of claim 10, wherein the ring seal is made of elastic material and adhered to the first plate and the second plate.

* * * * *